United States Patent [19]

Siminoff

[11] 4,304,163

[45] Dec. 8, 1981

[54] ADJUSTABLE NUT FOR STRINGED MUSICAL INSTRUMENT

[76] Inventor: Roger H. Siminoff, 112 Privada Luisita, Los Gatos, Calif. 95030

[21] Appl. No.: 89,200

[22] Filed: Oct. 29, 1979

[51] Int. Cl.[3] ..... G10D 3/04

[52] U.S. Cl. ..... 84/314 N; 84/307

[58] Field of Search ..... 84/314 N, 298, 299, 84/307

[56] References Cited

U.S. PATENT DOCUMENTS

| | | | |
|---|---|---|---|
| 294,832 | 3/1884 | Wichard | 84/298 |
| 727,203 | 5/1903 | Roberts et al. | 84/299 |
| 1,138,803 | 5/1915 | Shutt | 84/298 |
| 1,179,233 | 4/1916 | Shiley | 84/314 N |
| 1,338,583 | 4/1920 | Neft | 84/314 N |
| 2,499,194 | 2/1950 | McBride | 84/315 |
| 3,971,286 | 7/1976 | Borell | 84/314 N |
| 4,171,661 | 10/1979 | Rose | 84/314 N |

FOREIGN PATENT DOCUMENTS

| | | | |
|---|---|---|---|
| 1098375 | 1/1968 | United Kingdom | 84/307 |

*Primary Examiner*—Lawrence R. Franklin
*Attorney, Agent, or Firm*—Gottlieb, Rackman & Reisman

[57] ABSTRACT

A device for use with a musical instrument to facilitate independent adjustment of the spatial relationship between fretboard and each string.

7 Claims, 8 Drawing Figures

ADJUSTABLE NUT FOR STRINGED MUSICAL INSTRUMENT

This invention relates to stringed musical instruments, and more particularly, to mechanisms for adjusting the spatial relationship between a string and a fingerboard on a stringed musical instrument.

In recent years the music equipment industry has gone through a revolution in the construction and use of various instruments and devices. The amplified electronic music of professional performing groups like "The Who" and "The Rolling Stones" is as commonly heard as the classic refrains of Bach and Beethoven. This "new" music often requires that subtle tones be reproduced and amplified with great clarity. One problem in string instruments created by this amplification is that heretofore unnoticed distortions and imperfections will be amplified along with pleasant sounds, even though it is often not desirable to hear many of these distortions. Such distortions may arise, for example, where a string of a guitar vibrates against the fret members of a guitar producing a "buzz" sound. When amplified, this "buzz" sound can become loud, annoying and distracting. Instrumentalists may labor for many hours, making delicate, and often frustrating trial and error adjustments to their equipment so as to avoid this "buzz". The time lost on this labor can amount to hundreds of precious work hours.

In common instrument usage, the "nut" of a stringed instrument is an insert piece of bone, plastic or the like, which fits at the end of the fingerboard and acts as a support upon which the instrument's strings are positioned. A series of "V" shaped notches are molded or filed into the nut so that the strings are maintained in their respective lateral positions. The V-shaped notches also provide for a two-point contact to lock-in the string and to minimize buzzing or vibrational noises. Thus, as the string enters the notch from the peghead, a first contact is made, while a second contact point is present when the string emerges from the notch and proceeds toward the frets.

The nut also plays an important role in determining the height of the string above the fingerboard, commonly referred to as "action". This parameter is considered of importance to many players of stringed instruments because of the unique or distinctive playing "feel" and speed they are able to obtain, depending upon the particular "action" characteristic of an instrument's structure. Previous designs, however, allow for little or no adjustment of this "action", thereby limiting the versatility of a player operating with a particular instrument. In some cases, the vertical adjustment of a string at either the neck end or bridged end of the strings can only be accomplished by a similar vertical adjustment to all of the strings on the instrument. In other cases, mechanisms have been devised to permit vertical adjustment of each individual string, but such mechanisms do not provide the certainty and reliability of either the aforementioned V-shaped notches or the two-point contact. Such prior art structures are also disadvantageous because they are complicated in structure and hence expensive to manufacture and use. Other arrangements have provided that in order to avoid unwanted "buzzing", a string must fit exactly into a slot so as not to vibrate against the slot's walls. Still other devices have allowed a string to lie on a flat surface of an adjusting screw, therefore not being assured of correct intonation or vibrating length.

It is, therefore, an object of this invention to obviate one or more of the aforesaid inadequacies.

It is another object of this invention to provide the instrumentalist with an adjustable nut assembly for individually adjusting the spatial relationship between each instrument string and fretboard.

It is a further object of this invention to provide a mechanism for vertical adjustment of each individual string which is simple, uncomplicated, does not require hand filing of the nut, and is less expensive to manufacture than existing devices.

Yet another object of this invention is to provide improved string adjusting means for guitars or the like where the adjustment of the nut height of one string will not affect the other strings while reliable contact points for the string are provided.

Still another object of this invention is to provide adjustable inserts for the "nut" of an instrument which can vary the "action" of a string with respect to the fretboard.

And it is still a further object of this invention to provide for easily made owner adjustment of string height to satisfy individual playing preferences.

Additional objects and advantages of this invention will become apparent when considered in conjunction with one particular illustrative embodiment of the invention, wherein a typical adjustable nut includes an underlying support piece similar in shape to nuts currently in use. The support piece is provided with a number of holes corresponding to the number of strings or string pairs of the particular instrument. These holes are tapped or threaded to accommodate a threaded metal insert, the holes and inserts being threaded with a very shallow thread pitch so that very fine vertical adjustments can be made as the insert is rotated in its fitting. The insert may be turned like a common screw, thereby permitting it to be raised or lowered with respect to the underlying support mechanism; slots in the insert's upper surface may be used to effect rotation, although manual rotation is also envisioned. The inserts are arranged at an acute angle from the vertical, which angle results in the inserts slanting back toward the peghead of the instrument; the threads of the inserts and their accommodating holes permit appropriate adjustment along the angular axis.

The head of each insert is slotted so as to accept and hold a string (for a four, five of six-string instrument) or string pair (for a paired-string instrument). In one embodiment of the insert, two slots are cut into the surface of its head and are positioned perpendicular to each other. Each slot can accommodate one string, thus being suitable for a six-string instrument. In another embodiment, two pairs of parallel slots are provided, each pair perpendicular to the other pair. In the latter case, six inserts, for example, would thereby be able to accommodate an ordinary twelve-string instrument. In each instance, as a particular string enters the slot at the peghead end, it rides in the slot and emerges in contact with the opposite edge of the insert's slot, thereby providing a definite point of departure as the string proceeds toward the frets of the instrument.

As stated above, the aforementioned slots or pairs of slots are cut into the head surface of the insert at right angles to each other. The function of such design is to facilitate a quarter-turn, 90° adjustment of the insert rather than requiring a half-turn, 180° adjustment. The resultant device enables a very accurate fine tuning of the action, given the shallow pitch of the threads. Thus, an entire turn of an insert will result in a minute change in its vertical height. A half or quarter-turn adjustment will result in a correspondingly finer adjustment.

The slots in the head or upper surface of the insert are generally V-shaped to provide reliable gripping or holding action for the string. Such a shape results in more positive sideways positioning for the string and also resists longitudinal slippage. A more definite vibrational length is also achieved by the V-shaped slots.

It is, therefore, a feature of an embodiment of this invention that an appropriate number of threaded holes are spatially located in a nut base according to the string requirements of a particular instrument.

It is another feature of an embodiment of this invention that these holes receive inserts with correspondingly shallow threads, such that an entire revolution of the insert will result in minimal vertical displacement of the insert.

It is a further feature of an embodiment of this invention that the threaded inserts are tilted back toward the neck end-piece from the horizontal plane of the fretboard.

It is still another feature of an embodiment of this invention that the head surface area of each insert is slotted or notched in a V-shape.

It is also a feature of an alternative embodiment of this invention that said insert has two parallel slots placed at right angles to a second pair of parallel slots on the head surface area of an insert to facilitate use of said insert in paired string instruments.

Additional objects, features and advantages of the present invention will become apparent when considered in conjunction with a presently preferred, but nonetheless illustrative, embodiment of the invention as explained in the following detailed description and as shown in the accompanying drawings, wherein.

The drawings illustrate the invention in connection with a conventional six-string guitar, although it will be appreciated that the invention is applicable to a variety of stringed musical instruments, including banjos, mandolins, ukuleles, violins and the like. The main components of the invention, to be described hereinafter, are a nut base, six threaded bores spaced equidistantly along the upper surface of the nut base, the bores being angled backward toward the neck end (which carries the string pegs), six threaded inserts threadedly mated with said bores, and notches cut into the head surface area of each insert, each notch being "V"-shaped and in which a string may rest, with selected opposing notches intersecting at right angles.

Figure 1:
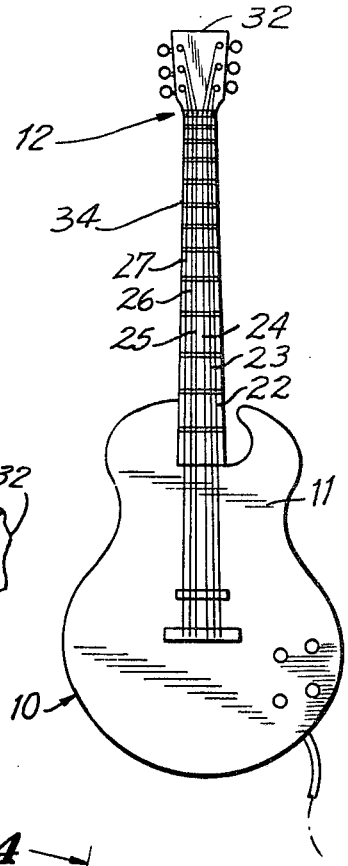
FIG. 1 is a top plan view of a typical six-string guitar with which the adjustable nut of this invention is adapted to be used.
Figure 2:
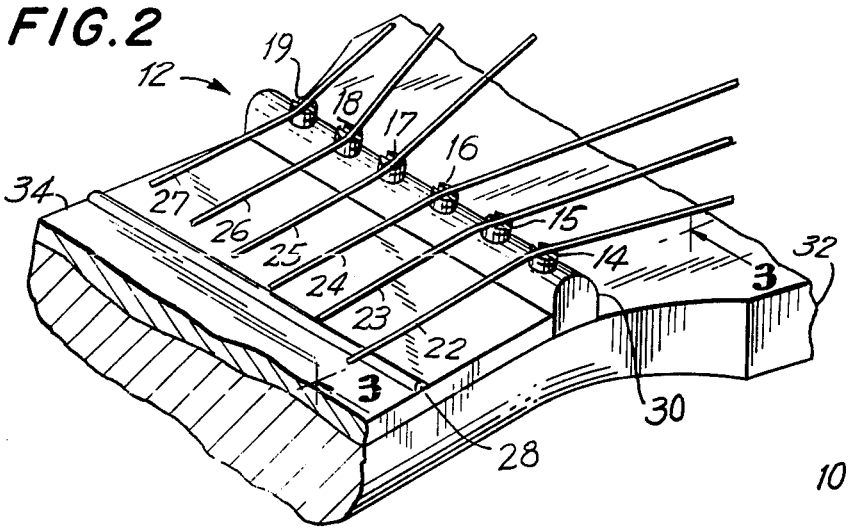
FIG. 2 is a enlarged fragmentary perspective view showing the device of the invention as incorporated at the junction of the neck and peghead portion of a typical six-string guitar.

The overall invention is illustrated in use in FIG. 1 as it is incorporated into a typical six-string guitar 10, inwhich strings 22–27 run from the peghead end 32 of the instrument 10 across the adjustable nut assembly 12 and then proceed down the fretboard 34 to the strumming section 11 of the instrument. The passage of the strings over frets 28 establishes the normal fret-string spacing, with the string being depressed by a player's fingers so as to contact the fretboard 34 between the frets 28. In addition, the dimension "Z" is thereby established to create the adjustable "action" to be discussed below. The inserts for nut assembly 12 may be better seen in FIG. 2, where each of six strings 22–27 is supported by its own respective insert 14–19 mounted in nut base 30. Nut base 30 is constructed of bone, brass, aluminum, plastic, or comparably rigid material, and is affixed to the instrument 10 at the ordinary location for a typical guitar nut, namely at the junction of the fretboard 34 and the peghead end 32, as may be seen in FIGS. 1 and 2.

Figure 3:
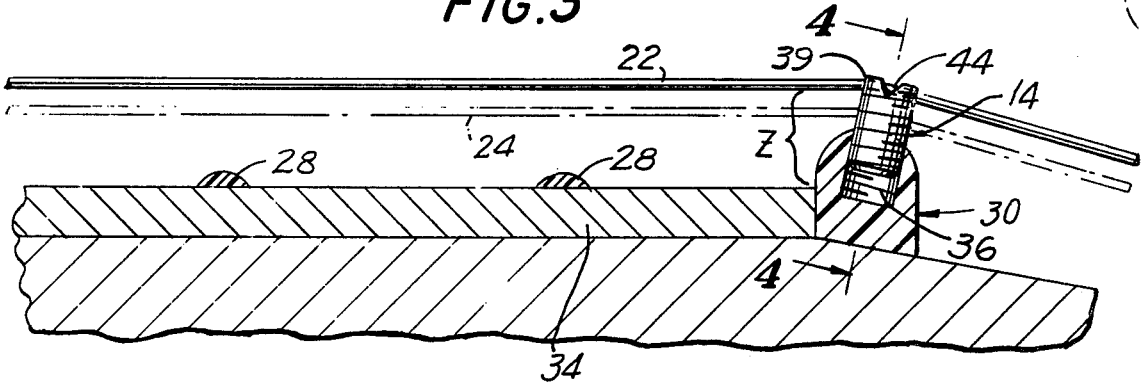
FIG. 3 is a fragmentary side cross-sectional view showing a string proceeding from the peghead portion at the right, through the insert and proceeding across the fretboard, taken along plane 3—3 of FIG. 2 in the direction of the arrows.

Referring to one insert for descriptive purposes, a typical insert 14 is threadedly mated with a typical bore 36 in nut base 30. String 22 is supported by insert 14 to a height Z above the fretboard 34, as seen in FIG. 3. For each of said inserts, a correspondingly threaded bore 36 is provided. As also shown in FIG. 3, bore 36 is angled toward the neck end of the instrument at approximately 105° from the horizontal, an illustrative angle which provides a rearward departure terminal for a string (such as 22) as it proceeds over the frets 28. This terminal point is located immediately below edge 39 as illustrated in FIG. 3. When string 22 extends to the left in FIG. 3 from insert 14 and toward the main portion 11 of guitar 10, its vibrating length will be measured from the terminal contact point below edge 39 on insert 14 to the opposite terminal at the bridge end of the instrument where the string is fixed in place on the body 11. Insert 14 is adjusted within bore 36 in the nut base 30, so that the height of its upper surface (carrying slots 44 and 46) is appropriate for the individual player with respect to fretboard 34. In this manner, dimension Z is adjusted for each string 22–27 whenever necessary or desired. This allows individualized control of the "action" (Z) of each string, with each player having the capability of adjusting the strings to his own preference.

Figure 4:
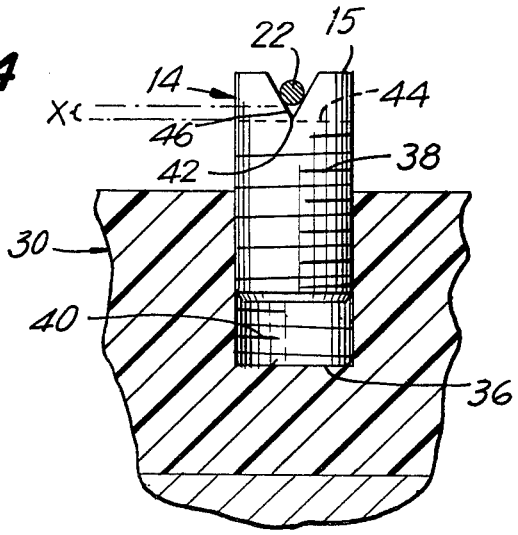
FIG. 4 is an enlarged fragmentary cross-sectional view of one embodiment of an insert, showing a single V-shaped notch and a string therein, taken along the line 4—4 of FIG. 3 in the direction of the arrows.
Figure 5:
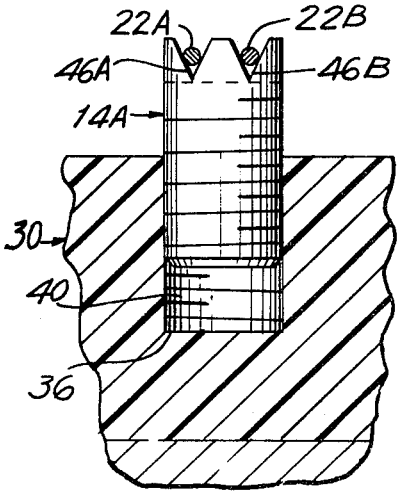
FIG. 5 is an enlarged fragmentary cross-sectional view of an alternative embodiment of an insert, comparable to the view of FIG. 4, showing two V-shaped notches in its head surface with two corresponding strings therein.

Various configurations of insert 14 may be envisioned. The insert shown in FIGS. 3–5 is cylindrical and is threaded to be received into bore 36 of nut base 30. The recommended thread size for said insert and bore is on the order of 6/40 or 6/56 threads per inch, thus insuring a fine adjustment of height for each turn or half-turn of the insert. An alternate embodiment 54 of insert 14 is shown in FIGS. 6–7, which resembles a flat-head machine screw with a broad round-head 56 placed over relatively narrow cylindrical shaft 58.

In the version of insert 14 shown in FIGS. 3 and 4, the upper surface 15 is provided with a V-shaped notch 46 within which typical string 22 rests. An insert 14 moves vertically within threaded bore 36, string 22 moves up or down accordingly. As a practical matter, adjustment of insert 14 may require temporary withdrawal of string 22 from notch 46—once the proper vertical height is reached, the string can resume its normal position within the notch.

A similar but modified insert embodiment 14A is shown in FIG. 5. This element is usable for dual string support, as in the case of a twelve-string guitar. Thus, there are two corresponding notches 46A and 46B, each carrying a respective string 22A and 22B. (Notches 44A and 44B are not visible in FIG. 5.) In other respects, the inserts 14 (FIGS. 3–4) and 14A (FIG. 5) are substantially identical.

Figure 6:
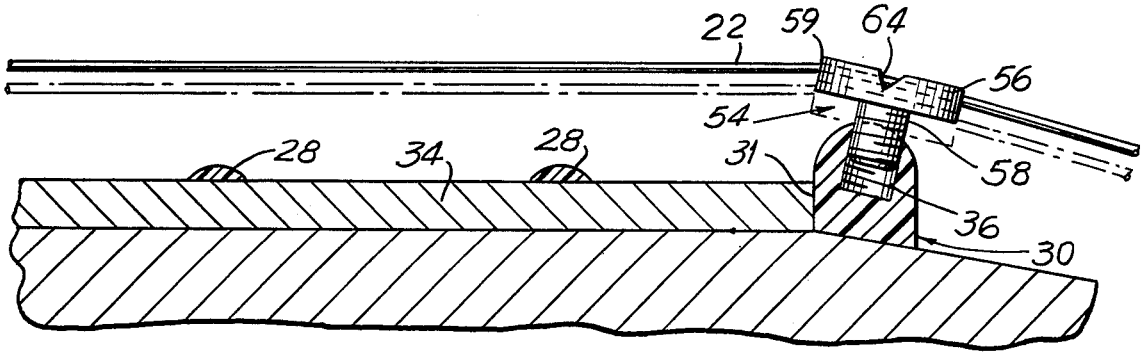
FIG. 6 is a fragmentary side cross-sectional view of an alternate embodiment of an insert according to the invention, showing a flathead screw-type configuration of an insert, and supporting a string comparable to the arrangement shown in FIG. 3.
Figure 7:
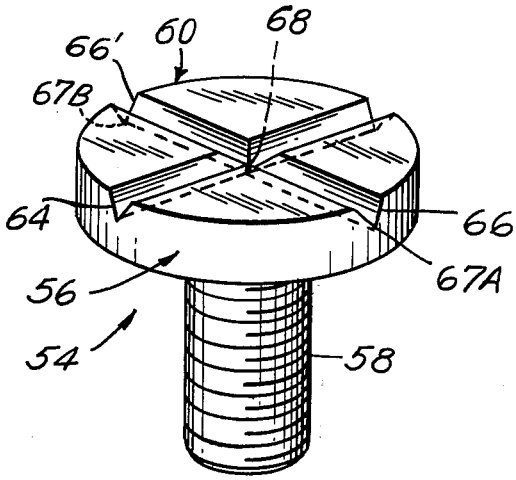
FIG. 7 is a top perspective view of the alternative embodiment of the insert of FIG. 6 showing two perpendicular notched grooves cut into its head surface area.
Figure 8:
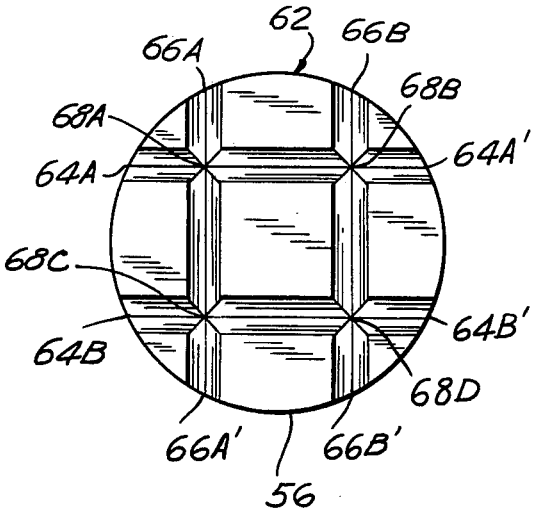
FIG. 8 is a top plan view of the surface area of the head of another alternative embodiment of an insert, showing two pairs of parallel grooves, one pair meeting the other at right angles.

The configuration of the top surface area 60 of the head 56 of a modified insert 54 is shown in FIGS. 6 and 7, where a configuration for a six-string instrument is shown. It will be seen that notch 66—66' (FIG. 7) bisects and is perpendicular to notch 64—64', both notches intersecting at center point 68. An alternate insert head configuration 62 is shown in FIG. 8, which would accommodate a pair of strings of a paired-string instrument (e.g., a twelve-string guitar) where notches 66A—66A' and 66B—66B' are shown parallel to each other and perpendicular to a second pair of parallel notches 64A—64A' and 64B—64B', the notches intersecting at points 68A–D. In the embodiments of FIGS. 6–8, the strings are carried in the designated notches as with inserts 14 and 14A described above. However, these "headed" embodiments permit somewhat more ready access for manual tuning of the inserts, and also provide a more definite departure point for the strings as they proceed over the frets 28. As shown best in FIG. 7, the departure point for a string in notch 66—66' can either be at point 67A or 67B, depending on the orientation of insert 54. The threaded embodiments of FIGS. 6–8 also assures that the string departure point, such as at 67A, 67B, will be directly over the fretboard end 31 so that the length of the string 22 will correspond with the length of the fretboard 34.

In use, a typical string 22 will be securely nestled in notch 44 or 46, in the case of six-string instruments, or in the corresponding notches of a paired-string embodiment. The six-string embodiment (shown in FIG. 4) has string 22 nestled in notch 46 of insert 14. It will be seen that the string 22 rests in the "V" notch 46 a distance "X" from the bottom 42 of said notch. In the alternate embodiment shown in FIG. 5, two strings 22A and 22B are each nestled in a corresponding notch 46A and 46B, respectively, of insert 14A; the insert is threadedly secured in bore 36 of nut base 30.

In typical operation, an instrumentalist would either purchase an instrument with an adjustable nut in accordance with the invention or would replace the standard nut on his stringed instrument with the invention, affixing the nut base 30 to the instrument 10 in a conventional manner. Thereafter, the invention may function as a standard nut, but with the added features of easily adjustable action and minimized unwanted vibration of the strings. When the action of a string is desired to be adjusted, subsequently, either at the factory or by an individual instrumentalist, the appropriate string, or string pair, is loosened and removed from the insert, whereupon adjustment may commence.

In the prior art, even where string adjustments were at all possible, they would involve cutting or filling the nut down to a new size, obviously a tedious and irreversible process relying on undesirable trial and error. Often, the V-notch would have to be reshaped after each adjustment. Moreover, even hard-filed notches would not avoid the buzzing because of the "flat" slidable relationship between the string and the notch. With the present device, an insert 14–19 may be selectively adjusted to any position, which is entirely variable, while the V-notch 46 also retains its form. Fine adjustments are effected by the shallow threading of the insert 14 and bore 36 co-acting with the quarter-turn adjustment facilitated by the perpendicular placement of the V-notches (FIGS. 5 and 8). Therefore, in actual use, a quarter-turn rotation of an insert will accomplish only a very minor change in the action of a string, and may be easily reversed if an incorrect adjustment has been made.

After suitable adjustments have been made, the strings are retightened. As seen in FIG. 4, string 22 is thus nestled into V-notch 46 such that the string is supported at the elevation "X" above the bottom 42 of the notch 46. Distance "X" is in part a function of the diameter of the string 22 and of the shape of the notch and is not of critical importance, as long as the string 22 does not contact and vibrate against the bottom junction 42.

Furthermore, in all embodiments of this invention, the inserts 14–19 (or 54 or 62) are set into nut base 30 at a back angle which may illustratively be approximately 105° measured from the horizontal plane of the fretboard 34 toward the neck end 32 of the instrument 10. This canted position further reduces the likelihood of improper or extraneous string vibrations.

Unwanted buzzing of strings against the conventional nut may be minimized by the aforementioned canted design in the invention. Specifically, the area of vibrational contact of a string with an insert is focussed at the leading edge of the insert, for example, at leading edge 39 of insert 14 (FIG. 3), or leading edge 59 (FIG. 6) of insert 54. This focussing is achieved by the backward cant of the inserts. Vibration of the string is effectively damped by focussing initial string-insert contact at the forward edge of the insert head. If the insert is not canted in accordance with this invention, the string may still vibrate against the entire surface of a flat prior art notch and result in unwanted buzzing. Canting the inserts so that the string vibrations are focussed and damped at the leading edge of the insert is a desirable goal and achievement of this invention.

It is to be understood that the above-described embodiments are merely the illustrative of the application of the principles of this invention. Numerous variations may be devised by those skilled in the art without departing from the spirit or scope of the invention.

What is claimed is:

1. Apparatus for use with a musical instrument having a fretboard with a plurality of frets, a peghead and a plurality of strings facilitating independent adjustment of the spatial relationship between said frets and each of said strings or pairs thereof, comprising, in combination, support means attached to said musical instrument for aligning and positioning said strings and including a plurality of receiving chambers corresponding to the number of said strings or pairs thereof, a corresponding plurality of adjustable inserts for carrying said strings, each said chamber adapted to accommodate one of said adjustable inserts, said inserts being mounted in said chambers at a predetermined angle as to incline away from the fretboard and toward said peghead to establish a terminal departure point for each of said strings or pairs thereof, and including guide means for effecting said independent adjustment by selectively controlling the movement of each of said inserts into or out of said chambers in axial alignment with said predetermined angle.

2. Apparatus in accordance with claim 1 wherein each of said inserts has an overhanging upper surface including means for receiving corresponding ones of said strings or pairs thereof, said means for receiving comprising a channel.

3. Apparatus in accordance with claim 2 wherein said channel is in the shape of a substantially V-shaped notch.

4. Apparatus in accordance with claim 2 wherein said channel includes a pair of opposed walls, each of said strings being supported between corresponding ones of said walls of said channel by physical contact of said strings against said walls to preclude said strings' contact with and vibration against the bottom junction of said walls of said channel.

5. Apparatus in accordance with claim 1 wherein said inserts include at least a leading edge, and wherein said guide means includes mutually engageable means between said chambers and said inserts whereby said chambers and said inserts are mutually canted at a back angle of approximately 105° from the horizontal plane of said fretboard in a direction toward said peghead; said terminal departure point for said string being defined against said leading edge of said insert to terminate vibrations of said strings thereby.

6. Apparatus in accordance with claim 1 wherein said insert comprises a threaded shaft included in said guide means and an over-hanging head relative to said shaft, said head having a channel for carrying said string therein and said departure point being defined at a circumferential junction of said channel and directly above said fretboard.

7. Apparatus in accordance with claim 1 wherein said insert comprises a threaded cylindrical body and at least one channel at one end thereof for carrying said string therein.

* * * * *